United States Patent [19]

Fish et al.

[11] Patent Number: 5,055,144

[45] Date of Patent: Oct. 8, 1991

[54] METHODS OF MONITORING PRECIPITATES IN METALLIC MATERIALS

[75] Inventors: Gordon E. Fish, Verona; Ryusuke Hasegawa, Morristown; Ernest D. Buff, Far Hills, all of N.J.

[73] Assignee: Allied-Signal Inc., Morris Township, Moris County, N.J.

[21] Appl. No.: 543,632

[22] Filed: Jun. 26, 1990

Related U.S. Application Data

[63] Continuation-in-part of Ser. No. 415,468, Oct. 2, 1989, abandoned, which is a continuation of Ser. No. 323,031, Mar. 10, 1989, abandoned, which is a continuation of Ser. No. 195,431, May 16, 1988, abandoned, which is a continuation of Ser. No. 81,620, Aug. 3, 1987, abandoned, which is a continuation of Ser. No. 913,556, Sep. 29, 1986, abandoned, which is a continuation of Ser. No. 689,215, Jan. 7, 1985, abandoned.

[51] Int. Cl.[5] ..... C21D 1/54

[52] U.S. Cl. ..... 148/129; 148/403

[58] Field of Search ..... 148/129, 403; 266/99, 266/90, 78

[56] References Cited

U.S. PATENT DOCUMENTS

| | | | |
|---|---|---|---|
| 2,059,976 | 11/1936 | Stargardter | 148/129 |
| 3,235,416 | 2/1966 | Jenkins | 148/129 |
| 3,793,717 | 2/1974 | Degenkolb et al. | 148/129 |
| 3,856,513 | 12/1974 | Chen et al. | 148/403 |
| 4,264,358 | 4/1981 | Johnson et al. | 420/429 |
| 4,595,427 | 6/1986 | Drew et al. | 148/129 |

OTHER PUBLICATIONS

Hasegawa & Ray, J. Appl. Phys. 49, 4174 12/1978, "Iron-boron Metallic Glasses".

Gallagher et al., J. Non-Cryst. Solids, 57, 251 12/1983, "The Influence of Small Amounts of Crystallinity on the Transport . . . ".

Dehghan et al., J. Non-Cryst. Solids 65, 87 12/1984, "Resistivity Measurements During the Crystallization . . .".

Mogro-Campero et al., J. Phys. 41, C8-497 12/1980, "Effect of Remnant Crystallinity on Resistivity of Amorphous Alloys".

Hasegawa et al., Proc. 4th. Intl. Conf. on Rap. Quenched Metals (Sendai, 12/1981) vol. II, p. 929.

Ramanan & Fish, J. Appl. Phys. 53, p. 2273 12/1982, "Crystallization Kinetics in Fe-B-Si Metallic Glasses".

Asahi et al., Jap. J. Appl. Phys. 21, L116-118 12/1982, "The Transformation Kinetics of Amorphous $Fe_{80}B_{20}$ and $Fe_{78}B_{20}Mo_2$. . .".

*Primary Examiner*—S. Kastler

*Attorney, Agent, or Firm*—Ernest D. Buff; Gerhard H. Fuchs

[57] ABSTRACT

A method and apparatus are provided for monitoring in situ the transformation of some fraction of a starting material to another material during the course of a thermal treatment. The starting material is heated to a preselected temperature and its resistivity is measured. A signal is transmitted to an actuator, which indicates cooling of the material when a preselected resistivity or change therein is detected.

12 Claims, 1 Drawing Sheet

$Fe_{79}Mo_3B_{12}Si_6$ 430° C Resistivity as a Function of Annealing Time.

METHODS OF MONITORING PRECIPITATES IN METALLIC MATERIALS

This application is a continuation-in-part of appl. Ser. No. 415,468, filed 10/2/89, which in turn, is a continuation of appl. Ser. No. 323,031, filed 3/10/89, which in turn is a continuation of appl. Ser. No. 195,431, filed 5/16/88, which in turn, is a continuation of appl. Ser. No. 081,620, filed 8/3/87, which in turn is a continuation of appl. Ser. No. 913,556, filed 9/29/86, which in turn is a continuation of appl. Ser. No. 689,215, filed 1/7/85 all abandoned.

1. FIELD OF THE INVENTION

The invention relates to methods for in situ monitoring of the transformation of a portion of some matrix material into another material and, more particularly, to the monitoring of the controlled devitrification of ferromagnetic metallic glasses.

2. DESCRIPTION OF THE PRIOR ART

It is a frequent objective in materials processing to use heat treatment to induce the transformation of some fraction of the starting material into another material. The use of precipitation hardening in copper-beryllium alloys is a typical example.

Another example is provided by metallic glasses which are frequently heat treated to achieve optimized properties. Many metallic glasses are used in magnetic devices such as transformers, inductors, recording heads, and the like. For these applications, technical magnetic properties such as coercivity, remanence, a-c core loss, exciting power, and permeability can be enhanced markedly by such heat treatment, which is frequently carried out in the presence of an applied magnetic field.

An example wherein carefully controlled heat treatment is needed to achieve desired final properties is provided by iron-based ferromagnetic metallic glasses intended for high frequency applications. In these materials, it has been shown (see, e.g., R. Hasegawa, G. E. Fish, and V. R. V. Ramanan, Proc. 4th Intl. Conf. on Rapidly Quenched Metals (Sendai, 1981), Vol. II, p. 929) that heat-treatment which gives a controlled precipitation of about 1 vol. % of $\alpha$-Fe in a metallic glass such as $Fe_{75}Ni_4Mo_3B_{16}Si_2$ results in a substantial decrease in ac core loss. A transformer or inductor having a core with reduced ac core loss beneficially operates at higher efefficiency with less heat produced.

As is known, metallic glasses (amorphous metal alloys) are metastable materials whose atoms lack any long-range order. X-ray diffraction scans of metallic glasses show only diffuse halos similar to those observed for inorganic oxide glasses. Metallic glasses are conventionally produced by techniques that allow a melt of the constituent chemical elements to be quenched at rates of $10^5$° C./sec or higher. Typical metallic glasses and methods for production thereof are taught in U.S. Pat. No. 3,856,513 issued Dec. 24, 1974 to Chen et al.

At elevated temperatures, metallic glasses are well-known to devitrify. That is, the starting material, which is homogeneous and has no periodic crystalline arrangement of its atoms, is transformed into an ensemble of crystalline particles having one or more chemical compositions. At an intermediate stage in the devitrification process, the material consists of an amorphous matrix containing a number of the aforesaid crystalline particles.

The thermal stability of metallic glasses is frequently characterized by techniques such as differential scanning calorimetry and differential thermal analysis. In these techniques, a sample is heated at a fixed rate of change of temperature with time, typically 10°-40° C./min, and the rate of transformation of the amorphous material into one or more crystalline materials is recorded. That temperature at which the transformation begins is defined as the crystallization temperature.

However, if a sample of metallic glass is held at a temperature below the crystallization temperature, thus determined, a devitrification process will begin after some length of time. This time becomes shorter as the temperature selected approaches the crystallization temperature.

Thus, for applications of metallic glasses, in which it is desired to produce a small amount of crystallinity in the glassy matrix, one can choose a temperature at which a heat treatment of reasonable and convenient duration produces the desired amount of precipitation. However, because of the inevitable variation of alloy chemistry and crystallization kinetics, samples from different batches of starting material will show variation in the degree of transformation for a given fixed temperature and duration of this heat-treatment.

A number of techniques are widely applied to the analysis of transformation reactions, including transmission electron microscopy (TEM), optical microscopy (OM), X-ray diffraction (XRD), and thermal techniques such as differential scanning calorimetry (DSC) and differential thermal analysis (DTA). Each of these techniques has certain disadvantages which preclude its use for in situ testing of finished articles. TEM requires that a sample be prepared with a thickness less than about 200 nm. OM requires that samples be prepared using conventional metallographic polishing and etching to reveal the character of the bulk of a sample. OM has the further limitation of only sensing transformed regions that are at least about 1 $\mu$m in size. XRD places stringent requirements on sample geometry, especially for examination of samples at elevated temperatures.

Thermal techniques have been used to sense the changes in specific heat that characterize transformation reactions. However, these changes are so small that measurements must be carried out under very carefully controlled conditions. For example, commercially available DSC instruments have been used for laboratory studies of crystallization of metallic glasses. (see, e.g., V. R. V. Ramanan and G. E. Fish, J. Appl. Phys. 53, 2273 (1982)). However, such studies are not adapted to the study of the initiation of transformation reactions, wherein the extent of transformation is small, owing to problems of the stability of the baseline in the instrumentation.

Furthermore, none of the above-mentioned techniques is adapted to the in situ monitoring of the extent of transformation during the course of heat treatment of an article which has been formed into a desired final size and with arbitrary shape.

Electrical and magnetic testing methods are widely practiced in the field of non-destructive evaluation. Magnetic particle techniques, such as the Magnaflux process, are primarily useful for detecting defects such as large cracks in ferromagnetic bodies and for detecting ferromagnetic inclusions in non-magnetic objects. The information thus provided identifies and localizes individual macroscopic defects but does not characterize an object in microscopic detail or in an averaged sense. That is, the Magnaflux process is not sensitive to small defects (size less than 1 μm) and does not provide an average determination of defect density.

Eddy current testing senses both electrical resistivity and magnetic permeability. Like magnetic particle methods, it is widely used for detecting gross defects. Eddy current and four-probe resistivity methods have also been applied to systems in which electrical resistivity is known to be a reliable indication of another desired property. Examples of this include age-hardening of AlCuMg, AlMgSi and AlMgZu alloys, the austenite-martensite transformation in low carbon steels, and order-disorder transformations in $Cu_3Au$.

Magnetization and resistivity methods have been used previously to characterize metallic glasses which are substantially devitrified, that is to say, more than 10% transformed. Asahi et al. (Japan. J. Appl. Phys. 21, L116-118 (1982)) have studied the electrical resistivity of amorphous $Fe_{78}MO_2B_{20}$ after the alloy is substantially devitrified. Hasegawa and Ray (J. Appl. Phys. 49, 4174 (1978)) have used the rapid increase in magnetization at a given temperature in a non-isothermal experiment to identify the crystallization temperatures, as discussed above in the context of DSC, for $Fe_{100-x}B_x$ alloys. They identified, for example, crystallization temperatures of 565, 655 and 680K for x=12, 16 and 22. Neither of these techniques has been applied to determine transformations of a small fraction (less than about 10%) of a metallic glass into its devitrification products. Furthermore, these references teach the use of measurement of resistivity and magnetization during heating at a constant rate of increase of temperature (constant heating rate).

Measurements of resistivity of partially crystallized metallic glasses have also been reported in B. L. Gallagher et al., J. Non-Cryst. Solids 57, 251 (1983), K. Dehghan et al., J. Non-Cryst. Solids 65, 87 (1984), and A. Mogro-Campero et al., J. Phys. 41, C8-497 (1980).

The Gallagher et al. article discloses that low levels of crystallinity of the order of 1.5% affect the electrical transport properties of metallic glasses. Such properties include the electrical resistivity, the temperature coefficient of resistivity, the Hall coefficient, and the thermopower. It is further disclosed that when $Cu_{60}Zr_{40}$ metallic glass is stored for several months at room temperature the increase in crystallivity due to surface oxidation gives rise to changes in transport properties. Dehghan et. al. determined the resistivity of FeB metallic glasses as a function of time during a constant heating rate experiment (constant rate of change of temperature with time). They identified the crystallization temperatures of the metallic glasses as the temperatures at which the electrical resistivities fell sharply. They further used the resistivity measured after the sharp drop to determine the fraction of metallic glass transformed into body centered cubic iron (α-Fe) precipitate in a two-step devitrification reaction.

Mogro-Campero et al. disclose that certain Co-B alloys produced by rapid quenching from the melt onto a rotating drum contain a small volume fraction of remnant crystallinity within a predominantly glassy matrix. These crystals are disclosed to change electrical transport properties such as the resistivity and the temperature coefficient of resistivity.

While the above-cited references generally disclose that the presence of crystallization in a predominantly glassy matrix alters transport properties and that the transport properties change as the volume fraction of crystallities changes, they do not disclose that the transport properties or change therein can be measured and used to control a thermal annealing process in which it is desired to induce a chosen level of crystallization or in which it is desired to prevent an inadvertent devitrification of metallic glass during that anneal.

The use of thermal annealing is also disclosed in U.S. Pat. No. 4,264,358. In that Patent, it is disclosed that the upper critical current density of certain superconducting metallic glasses is increased by the presence of crystalline precipitates in the metallic glass. As is known in the art, a superconducting material is a material whose electrical resistivity vanishes below a critical temperature. When a superconducting material carries an electrical current whose density exceeds the upper critical current density, the material returns to the normal state from the superconducting state. Accordingly, materials with larger values of the upper critical current density are preferred. A thermal annealing treatment is taught by U.S. Pat. No. 4,264,358 as a method to enhance the upper critical current density by inducing transformation of a desired portion of the starting metallic glass into crystalline precipitates. A volume fraction of the crystalline particles of about 1-10% is suggested to be optimal. No technique is provided, however, for determining in situ the volume fraction transformed at each stage of the thermal annealing treatment or for terminating the thermal annealing treatment at the point at which the desired level of transformation is reached.

One of the most troublesome problems encountered in heat treatment of magnetic alloys is the difficulty of preventing variations in magnetic properties among batches of material subjected to heat treatment. The varying response of different batches of material to a given heat treatment reduces the yield and increases the cost of the material. There remains a need in the art for a technique adapted to the in situ monitoring of articles in their characteristic form and shape during heat treatment that give reliable indication of final properties.

SUMMARY OF THE INVENTION

The present invention provides a method and apparatus for monitoring in situ the transformation of some fraction of a starting material composed of an amorphous metal alloy into a transformed material during the course of a thermal treatment. Generally stated, the thermal treatment is used to anneal the starting material and the method comprises the steps of heating the starting material to a preselected temperature; measuring the resistivity of the material while at said temperature; and cooling the material The annealing time is controlled in situ as a function of the resistivity of the material, the latter being heated to a preselected temperature and maintained thereat until a preselected change in resistivity thereof is detected. The preselected change in resistivity that is detailed is a fractional change in resistivity ranging from about 0.01 to 0.2.

Further, the invention provides apparatus for monitoring in situ the transformation of some fraction of a starting material into another material undergoing an anneal. The apparatus comprises heating means for heating the starting material to a preselected temperature; measuring means for measuring the resistivity of the material; and cooling means for cooling the material. A signal means associated with the measuring means transmits an electrical signal to actuate the cooling means in response to a preselected change in the resistivity of the material.

BRIEF DESCRIPTION OF THE DRAWINGS

The invention will be more fully understood and further advantages will become apparent when reference is made to the following detailed description of the preferred embodiments of the invention and the accompanying drawings, in which.

DETAILED DESCRIPTION OF THE INVENTION

Figure 1:
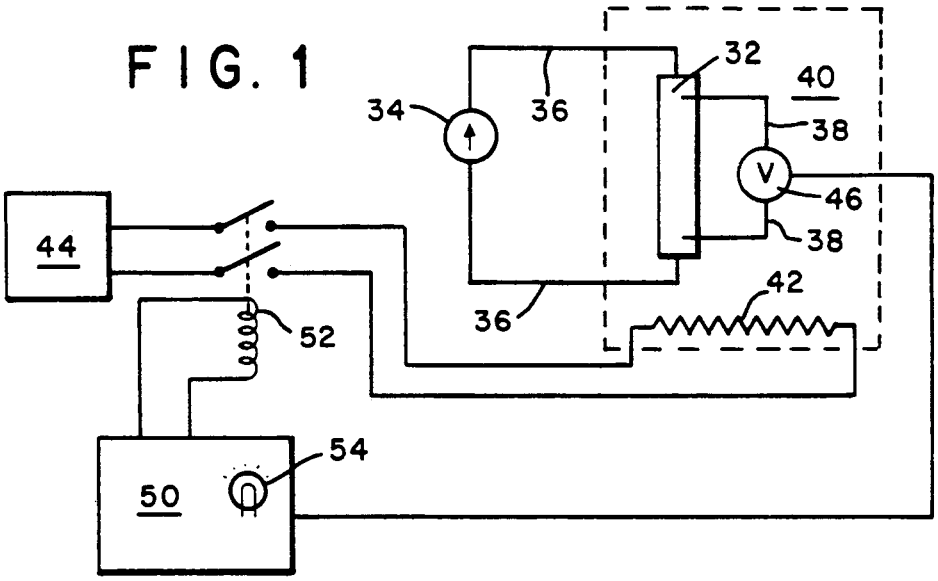
FIG. 1 is a schematic electrical diagram illustrating an apparatus for controlling the annealing of a strip of material, the control being a function of the resistivity thereof.

It is a principal objective of this invention to provide methods for the in situ monitoring of the extent of a transformation reaction induced by heat treatment of an article.

It is an advantage of the present invention that it can be practiced in the course of routine production of commercial articles in their characteristic form without need for use of a reference article against which the resistivity of the article being heat treated must be compared, that it allows use of standard electrical testing equipment, and that it Provides, during the course of a heat treatment, a semi-continuous characterization of the properties to be expected of the article in its finished form.

It is a further and more particular objective of this invention to provide methods for monitoring the controlled devitrification of ferromagnetic metallic glasses.

Iron-based boron and silicon containing metallic glasses such as Fe79B16Si5; $Fe_{75}Ni_4Mo_3B_{16}Si_2$; and $Fe_{79}Mo_3$Bhd 12$Si_6$ are frequently employed for high frequency (f>10 kHz) applications in transformers, inductors, and the like. Laboratory studies show that these materials may be optimally heat-treated at temperatures $T_a$ in the range 430°–460° C. for times $t_a$ of 1–4 hours. Such an anneal transforms about 1 vol. % of these glasses into crystallites having the body-centered cubic structure which contain predominantly iron. Such crystallites may either be distributed uniformly throughout the metallic glass or may be concentrated predominantly near or at either or both of the surfaces of the metallic glass.

High frequency magnetic properties of Fe-based metallic glasses are generally improved by the presence of a volume fraction of 0.005 to 0.10 of discrete crystalline particles of the constituents of the metallic glass. Optimal magnetic properties are obtained with a volume fraction of about 0.01. The particles can have either a crystalline $Fe_3B$ structure or, more preferably, a body centered cubic structure. The particles can also comprise a mixture of particles wherein a first portion thereof has a body centered cubic structure, a second portion has a crystalline $Fe_3B$ structure, and a third portion, if present, has a mixed structure (eutectic structure) having regions with body centered cubic structure and with $Fe_3B$ structure. The prior art method for control of heat-treatment of such metallic glasses is to heat treat a number of samples of the metallic glass and measure magnetic properties such as permeability, core loss, remanence and coercivity which must fall into a certain range and then to select a suitable temperature and duration of anneal. However, the optimal temperature and duration of anneal will vary from one batch of starting material to the next. Accordingly, a series of measurements must be made to optimize the heat-treatment for each batch of material, or the overall yield of heat-treated samples having acceptable magnetic properties will be low.

In general, the optimal heat-treating temperature for a metallic glass is greater than its Curie temperature. Hence, at the annealing temperature, it is impossible to measure the magnetic properties which depend inherently on the material being in its ferromagnetic state, i.e., below its Curie temperature.

It is the attainment of acceptable values for magnetic properties such as core loss, permeability, remanence, and coercivity at the desired end-use temperature that distinguishes acceptable material from unacceptable material.

The method of the present invention is also adapted to be used in the production of nanocrystalline alloys. These alloys are distinguished by microstructures having a substantial fraction of grain sizes below about 100 nm, a size smaller than the grain sizes of metal alloys produced by conventional means, which are typically at least 1 μm and can be as large as several mm. A representative class of nanocrystalline alloys has the composition $(Fe_{l-x}T_x)100-a-b-c-dCu_aM_bB_cSi_d$; where a, b, c, and d are in atom percent, T is Ni and/or Co, M is at least one member selected from the group consisting of Nb, W, Ta, Zr, Hf, Ti, and Mo, $0 \leqq x \leqq 0.5$, $0.1 \leqq a \leqq 3$, $0.1 \leqq b \leqq 30$, $0.1 \leqq c \leqq 25$, $0 \leqq d \leqq 30$, and $5 \leqq c+d \leqq 30$. Such materials may be prepared as nanocrystalline alloys by devitrification of parent materials which are substantially fully amorphous (metallic glasses). During a suitable heat treatment, a fraction of the starting material is transformed from the amorphous state to a microstructure with crystalline particles having an average grain size of 100 nm or less. Certain nanocrystalline alloys obtained by devitrifying metallic glasses exhibit attractive soft magnetic properties. The optimal grain size in the preferred nanocrystalline alloys is much smaller than that for the $Fe_{75}Ni_4Mo_3B_{16}Si_2$; $Fe_{79}Mo_3B_{12}Si_6$; and $Fe_{79}B_{16}Si_5$ examples described above, and the optimal fraction of the starting material which is transformed is significantly higher.

The extent of the devitrification reaction is carefully controlled in order to obtain a nanocrystalline alloy with soft magnetic properties optimal for the Particular operating conditions (such as frequency and maximum induction level) for the magnetic core in a given application. In general, the transformed material should comprise a volume fraction of crystalline particles ranging from about 0.1 to 0.8, and more preferably, from about 0.4 to 0.8. Preferably at least about 40% of the volume of the starting material is transformed into crystalline particles having a body-centered cubic crystal structure and an average grain size of about 10–50 nm.

It has been found that the transformation from the amorphous to the nanocrystalline structure is accompanied by a marked decrease in the electrical resistivity of the alloy. For example, a ribbon having the composition Fe73.5Cu1Nb3B6Si16.5 had a room-temperature resistivity of 1.40 μΩ-m in the as-cast amorphous state, but a lower room-temperature resistivity of 1.20 μΩ-m after being transformed to the nanocrystalline state by a heat treatment for 1 h at a temperature of 600° C. It is known in the art to be difficult to predict resistivities of fine-grained materials such as the nanocrystalline materials purely from the composition, since grain boundary and other effects play an important role in determining resistivity. The method of the present invention affords a practical way of monitoring and controlling the extent of the transformation to the nanocrystalline state effected by heat treatment.

There is a marked difference in the change in resistivity which accompanies the change from the as-cast anorphous state to the transformed state with optimal magnetic properties between the nanocrystalline alloys and examples such as the $Fe_{75}Ni_4Mo_3B_{16}Si_2$, $Fe_{79}Mo_3B_{12}Si_6$, and $Fe_{79}B_{16}Si_5$ alloys described above. The extent of transformation is much higher for the nanocrystalline materials, so the fractional change in resistivity is higher, ranging preferably from about 0.1 to 0.2.

In order to use the techniques described herein to monitor the extent of transformation of material being annealed, one would carry out preliminary experiments to determine what change in resistivity measured at the annealing temperature occurred in material optimally heat-treated as evidenced by conventional testing of finished articles after the heat-treatment. Further articles would then be heat-treated until the predetermined change in resistivity was seen to occur, then the heat-treatment would be terminated to produce finished articles having the desired end-use properties.

The techniques herein can also be used to monitor annealing of metallic glasses in which it is desired to preserve the glassy structure. Such an anneal is frequently used to enhance the magnetic properties of Fe and Co-based alloys, particularly those containing at least one member selected from the group consisting of boron, silicon, carbon and phosphorus, when the same are intended for line frequency (50–400 Hz) applications. In this case, the resistivity of the metallic glass would be monitored and if a change characteristic of the initial stage of devitrification were seen, positive indication could be given to an operator or the anneal could be terminated automatically and the metallic glass cooled to prevent further devitrification. Even though one is ultimately interested in magnetic properties at operating temperatures of, say, 100° C. or below, the control of annealing can be done at high temperature because of the correlation between presence of crystallites which changes the electrical resistivity and good properties at the operating temperatures of interest. Inevitable minor variations in processing parameters or alloy composition change the nominal anneal necessary for good properties. This method allows in situ compensation for these deviations. The measurements are simple enough to be done with standard laboratory constant current sources and volt meters.

This method of measuring transformation reactions is to utilize the electron transport properties of metallic materials. Inhomogeneities such as impurities and precipitates in homogeneous metallic materials have different effects upon the electrical resistivity $\rho$ depending on their size. In a conducting medium, the mean free path $\lambda$ is defined to be the mean distance that a conduction electron travels before being scattered. For amorphous materials, $\lambda$ is as small as a few times the average interatomic distance, i.e. of the order of 1 nm. Inhomogeneities whose size is of the order of $\lambda$ act as scattering centers which increase $\rho$ by impeding the flow of conduction electrons. Inhomogeneities much larger than $\lambda$ merely act as alternate current paths, so the overall resistivity is given by an average over all possible current paths.

Thus if one assumes the resistivity of the precipitates to be $\rho_p$ and that of the amorphous matrix to be $\rho_m$ the ratio of the total resistivity, $\rho$, to the matrix resistivity, is given by $$\rho/\rho_m=[2r+1-f(1-r)]/[2r+1+2f(1-r)]$$

where f=fraction of the precipitates and $r=\rho_p/\rho_m$. In the case in which the matrix is an amorphous Fe-base alloy and the inhomogeneities are precipitates of $\alpha$-Fe particles occupying of the order of 1 vol. %, the values of f and r are about 0.01 and 0.1, respectively. Thus 1 vol. % crystallinity corresponds to $$\rho/\rho m=0.977$$

This change is sufficiently large to be detected easily using the standard four-probe technique. The fractional change of resistivity ranges from about 0.01 to 0.2, and preferably from about 0.01 to 0.02, corresponding to an increase in volume fraction of crystallinity of about 0.005 to 0.01. By measuring the resistivity of a sample held at a constant annealing temperature, the effect of the temperature dependence of resistivity is eliminated and the change of resistivity with time is due predominantly to the transformation of some of the starting metallic glass into crystalline precipitates.

Electrical resistivity is conveniently measured using the standard four-probe technique. In this method, a specimen is chosen whose length is much greater than its other dimensions. Two leads are attached to each end of the specimen. Through one set of leads a current I is made to pass through the sample. The potential difference v between the other set of leads gives the resistivity p according to the formula $$\rho=\frac{V}{I}\ \frac{A}{l}$$

wherein p is in ohm meters, V is in volts, I is in amperes, A is the average cross-sectional area in $m^2$ and l is the distance between the voltage leads in m. For metallic glasses, p is typically $(0.8-1.5)\times10^{-6}\Omega$-m.

In FIG. 1 there is shown a schematic electrical diagram illustrating an apparatus for controlling the annealing of a starting material having the form of an elongated strip 32. A constant current source 34 supplies current through current leads 36 connected to the strip 32. The resultant electrical potential drop across strip 32 is measured between potential leads 8 connected to strip 32. The strip 32 is enclosed in a heating means comprising a furnace 40 having an electrical heating coil 42 powered by power supply 44. A measuring means for measuring the resistivity of strip comprises a voltmeter 46, with which is determined the potential across potential leads 38. Signal 50 means determines the change in resistivity of strip 32 from the ratio of the electrical potential drop to the current provided by constant current source 34. An actuating means comprising relay 52 operates upon receipt of a signal from signal means 50 to initiate cooling of the strip 32. In the embodiment shown, cooling is initiated when relay 52 opens and thereby interrupts the flow of electrical current from power supply 44 to heating coil 42. The signal means 50 further activates indicator means 54 when a preselected value of resistivity is determined.

The following example is presented to provide a more complete understanding of the invention. The specific techniques, conditions, materials and reported data set forth to illustrate the principles and practice of the invention are exemplary and should not be construed as limiting the scope of the invention.

EXAMPLE 1

A sample of metallic glass having composition $Fe_{79}Mo_3B_{12}Si_6$ and dimensions of about 3 cm long, 0.5 cm wide, and 25 μm thick, was chosen and two thin Cu wires were spot welded to each end. A small constant current I was applied using one of the leads at each end and the resulting potential V was measured between the other leads. The sample was contained in a tube furnace at 430° C. The resistivity which is proportional to V/I was monitored as a function of time at temperature.

The voltage drop across the sample was measured with both senses of current flow and the magnitudes averaged to eliminate the effects of dc offset and thermal emfs.

Figure 2:
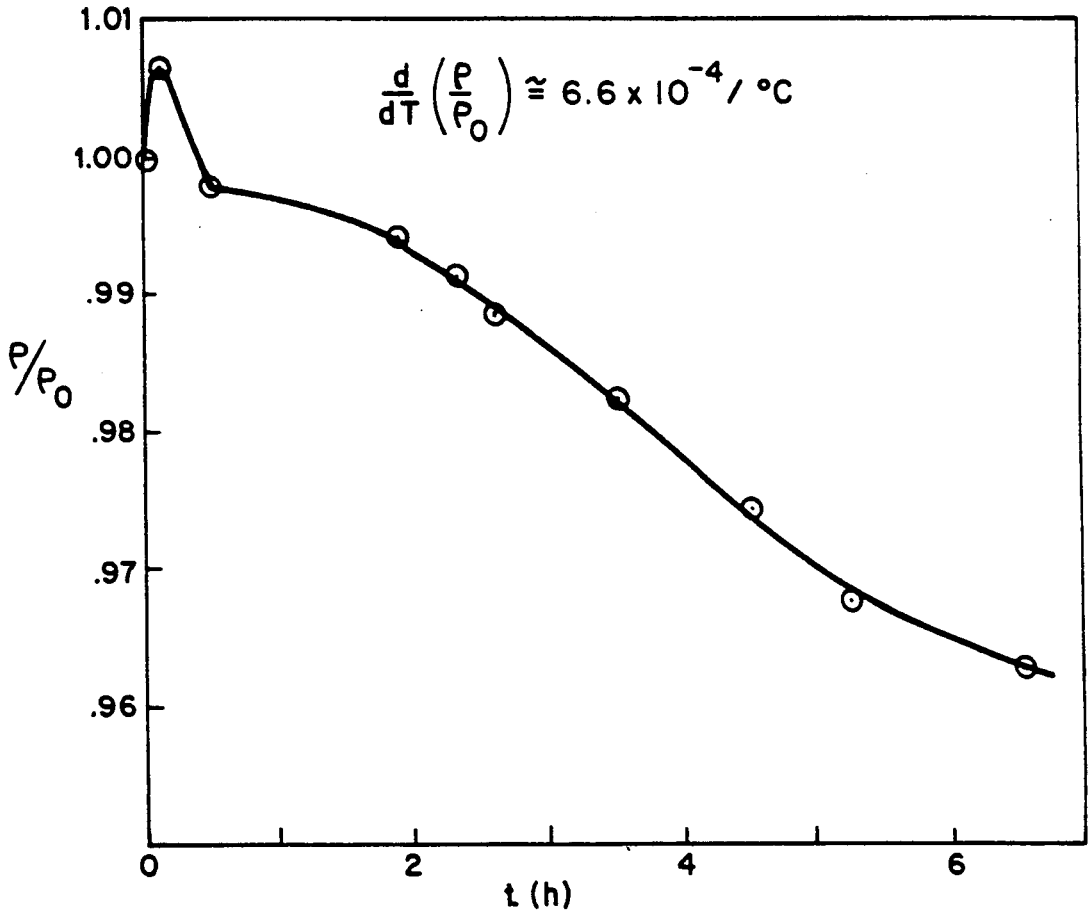
FIG. 2 is a graph containing a trace of the resistivity of the metallic glass $Fe_{79}Mo_3B_{12}Si_6$ as a function of time during an anneal at 430° C. The resistivity, measured using a four-probe dc technique, is normalized to the value determined immediately after the sample was heated from room temperature to 430° C.

The resistivity normalized to the value obtained immediately upon reaching 430° C., as a function of annealing time, is shown in FIG. 2. The decrease in resistivity shown was caused by precipitation of α-Fe in the sample which was confirmed by x-ray diffraction.

Having thus described the invention in rather full detail, it will be understood that this detail need not be strictly adhered to but that further changes and modifications may suggest themselves to one skilled in the art, all falling within the scope of the invention as defined by the subjoined claims.

What is claimed:

1. A method for annealing a starting material composed of an amorphous metal alloy wherein at least a portion of said starting material is transformed into a transformed material having a resistivity different from that of said starting material, comprising the steps of:

a heating said starting material to a preselected temperature;

b. measuring the resistivity of said material while at said temperature;

c. maintaining said starting material at said preselected temperature until a preselected change in resistivity thereof is detected, said preselected change in resistivity being a fractional change in resistivity ranging from about 0.01 to 0.2; and d. cooling said material when said preselected change in resistivity has been detected.

2. A method as recited in claim 1, wherein said fractional change in resistivity ranges from about 0.01 to 0.02.

3. A method as recited in claim 1, wherein said fractional change in resistivity ranges from about 0.1 to 0.2.

4. A method as recited in claim 1, wherein said starting material is a superconducting material.

5. A method as recited in claim 1, wherein said transformed material comprises crystalline particles of the constituents of said amorphous metal alloy.

6. A method as recited in claim 5, wherein said crystalline particles occupy a volume fraction of said transformed material ranging from about 0.005 to 0.10.

7. A method as recited in claim 5, wherein said crystalline particles occupy a volume fraction of said transformed material ranging from about 0.1 to about 0.8.

8. A method as recited in claim 7, wherein said volume fraction ranges from about 0.4 to 0.8.

9. A method as recited in claims 5, 7, or 8, wherein said transformed material is a nanocrystalline alloy.

10. A method as recited in claim 9, wherein said nanocrystalline alloy is composed essentially of an alloy having a composition $(Fe_{1-x}T_x)100-a-b-C-dCu_aM_bB_cSi_d$ where a, b, c, and d are in atom percent, T is Ni and/or Co, M is at least one member selected from the group consisting of Nb, W, Ta, Zr, Hf, Ti, and Mo, $0 \leqq x \leqq 0.5$, $0.1 \leqq a \leqq 3$, $0.1 \leqq b \leqq 30$, $0.1 \leqq c \leqq 25$, $0 \leqq d \leqq 30$, and $5 \leqq c+d \leqq 30$.

11. A method as recited in claim 1, wherein at least about 40% of the volume of said starting material is transformed into particles having a body-centered cubic crystal structure.

12. A method as recited-in claim 1, wherein said particles have an average grain size ranging from about 10 to 50 nm.

* * * * *